US010086427B2

(12) United States Patent
Go et al.

(10) Patent No.: US 10,086,427 B2
(45) Date of Patent: Oct. 2, 2018

(54) DEVICE AND METHOD FOR MELTING AND FORMING METAL IN VACUUM ENVIRONMENT

(71) Applicants: Dong Keun Go, Busan (KR); Myoung Su Go, Busan (KR)

(72) Inventors: Dong Keun Go, Busan (KR); Myoung Su Go, Busan (KR)

( * ) Notice: Subject to any disclaimer, the term of this patent is extended or adjusted under 35 U.S.C. 154(b) by 0 days.

(21) Appl. No.: 14/906,528

(22) PCT Filed: Jun. 5, 2015

(86) PCT No.: PCT/KR2015/005675
§ 371 (c)(1),
(2) Date: Jan. 20, 2016

(87) PCT Pub. No.: WO2015/199351
PCT Pub. Date: Dec. 30, 2015

(65) Prior Publication Data

US 2017/0113268 A1 Apr. 27, 2017

(30) Foreign Application Priority Data

Jun. 26, 2014 (KR) ..... 10-2014-0079018

(51) Int. Cl.

| | |
|---|---|
| ***B22D 17/12*** | (2006.01) |
| ***B22D 17/14*** | (2006.01) |
| ***B22D 17/04*** | (2006.01) |
| ***B22D 17/20*** | (2006.01) |
| ***B22D 27/15*** | (2006.01) |

(52) U.S. Cl.
CPC ..... *B22D 17/145* (2013.01); *B22D 17/04* (2013.01); *B22D 17/12* (2013.01); *B22D 17/203* (2013.01); *B22D 27/15* (2013.01)

(58) Field of Classification Search
CPC ..... B22D 17/12; B22D 17/14; B22D 17/145; B22D 17/2023; B22D 17/203
USPC ..... 164/65, 113, 256–258, 303–318
See application file for complete search history.

(56) References Cited

U.S. PATENT DOCUMENTS

| | | | | |
|---|---|---|---|---|
| 2,068,875 A * | 1/1937 | Smith | ..... | B22D 17/12 164/314 |
| 3,823,760 A * | 7/1974 | Bloomfield | ..... | B22D 18/04 164/113 |
| 4,088,178 A * | 5/1978 | Ueno | ..... | B22D 17/12 164/312 |

(Continued)

FOREIGN PATENT DOCUMENTS

| | | | |
|---|---|---|---|
| JP | 04231161 A * | 8/1992 | |
| JP | 07016726 A | 1/1995 | |

(Continued)

OTHER PUBLICATIONS

KIPO Notification of Reason for Refusal dated Nov. 4, 2014.
KIPO Notification of Reason for Refusal dated Jan. 14, 2015.

*Primary Examiner* — Kevin E Yoon

(57) ABSTRACT

An apparatus and method for melting and forming metal in a vacuum environment. Metal is melted within a metal-forming apparatus and the molten metal is filled into a mold cavity. A high-level vacuum environment is created in the apparatus by drawing air from the apparatus which is sealed from atmospheric air. This makes it possible to reduce contact with air, which can improve the quality of the metal product.

9 Claims, 11 Drawing Sheets

(56) References Cited

U.S. PATENT DOCUMENTS

| | | | | | |
|---|---|---|---|---|---|
| 5,860,468 | A * | 1/1999 | Cook | B22D 17/14 | 164/113 |
| 6,899,159 | B2 * | 5/2005 | Fischer | B22D 18/04 | 164/119 |
| 7,246,649 | B2 * | 7/2007 | Muramatsu | B22D 17/14 | 164/256 |
| 7,284,592 | B2 * | 10/2007 | Yamada | B22D 17/007 | 164/312 |
| 7,614,440 | B2 * | 11/2009 | Muramatsu | B22D 17/12 | 164/113 |
| 8,104,528 | B2 * | 1/2012 | Tsuchiya | B22D 17/10 | 164/113 |
| 2006/0254747 | A1 * | 11/2006 | Ishida | B22D 17/12 | 164/312 |
| 2012/0111522 | A1 * | 5/2012 | Bullied | B22D 17/2038 | 164/113 |
| 2014/0083640 | A1 * | 3/2014 | Waniuk | B22D 17/002 | 164/113 |

FOREIGN PATENT DOCUMENTS

| | | | | |
|---|---|---|---|---|
| JP | 08501259 | A | 2/1996 | |
| JP | 10296424 | A | 11/1998 | |
| JP | 2004122143 | A | 4/2004 | |
| JP | 3599729 | B2 | 12/2004 | |
| JP | 4224024 | B2 | 2/2009 | |
| KR | 101395022 | B1 | 5/2014 | |
| WO | 2004002658 | A1 | 1/2004 | |
| WO | WO 2013158069 | A1 * | 10/2013 | B22D 17/02 |

* cited by examiner

[FIG. 1]
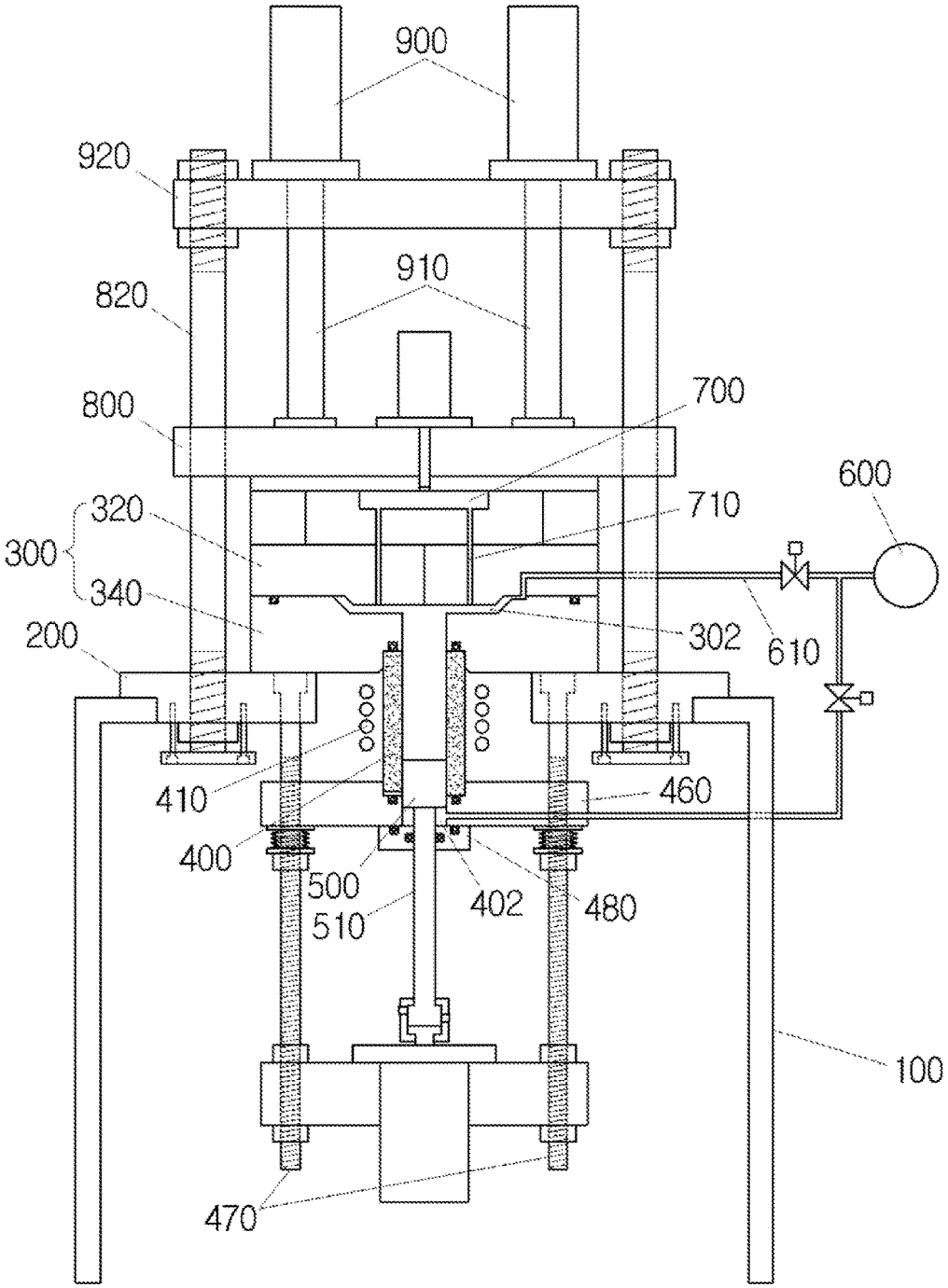

[FIG. 2]
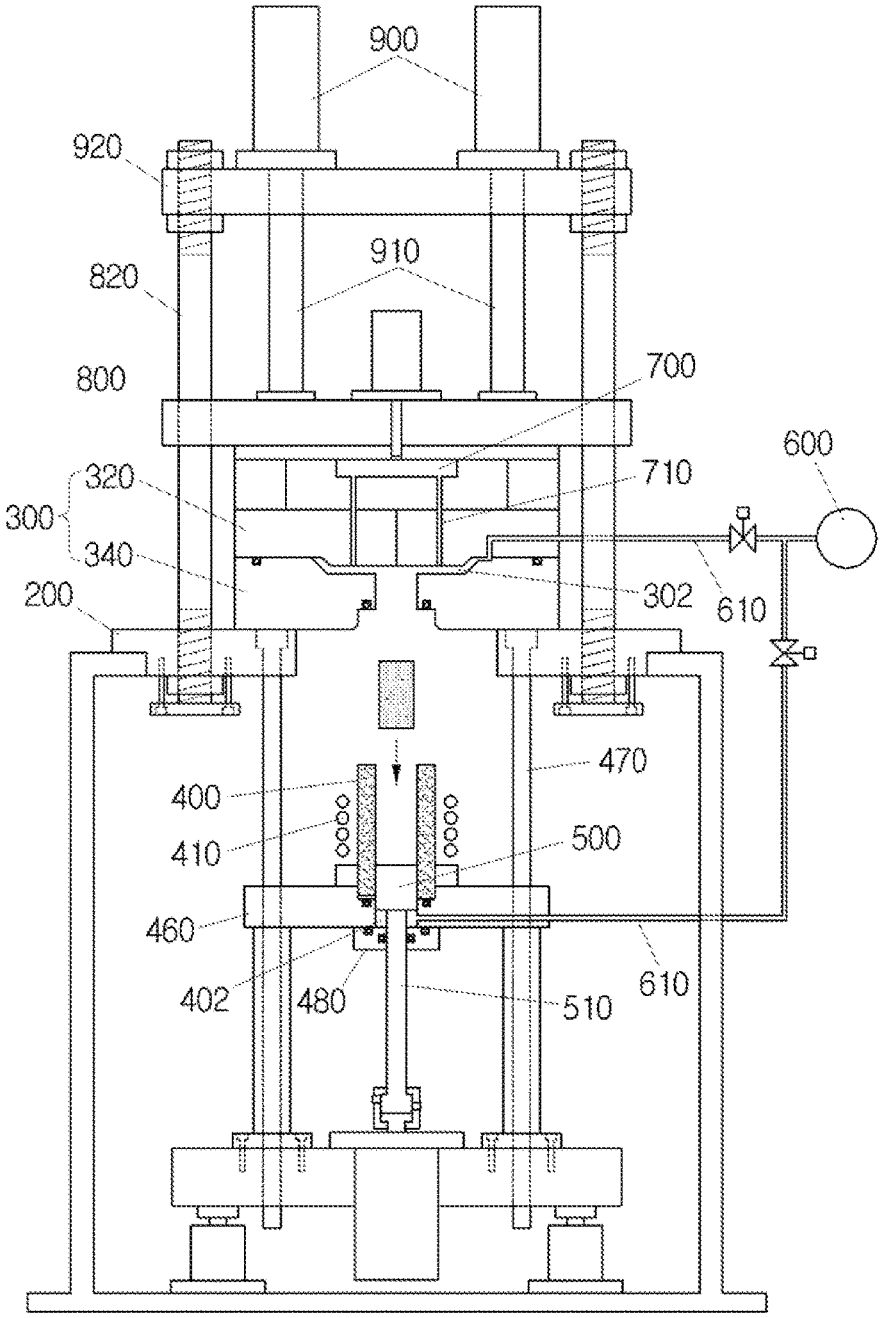

[FIG. 3]
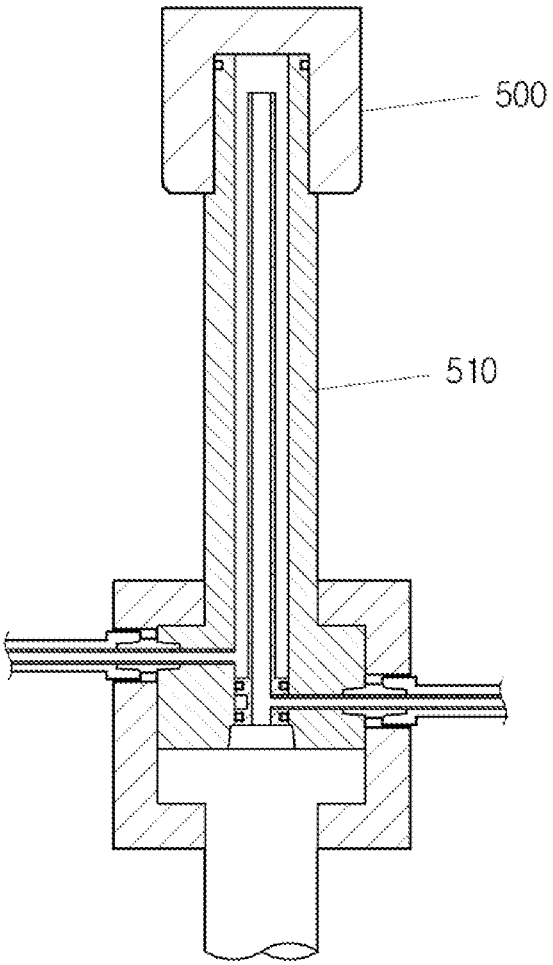

[FIG. 4]
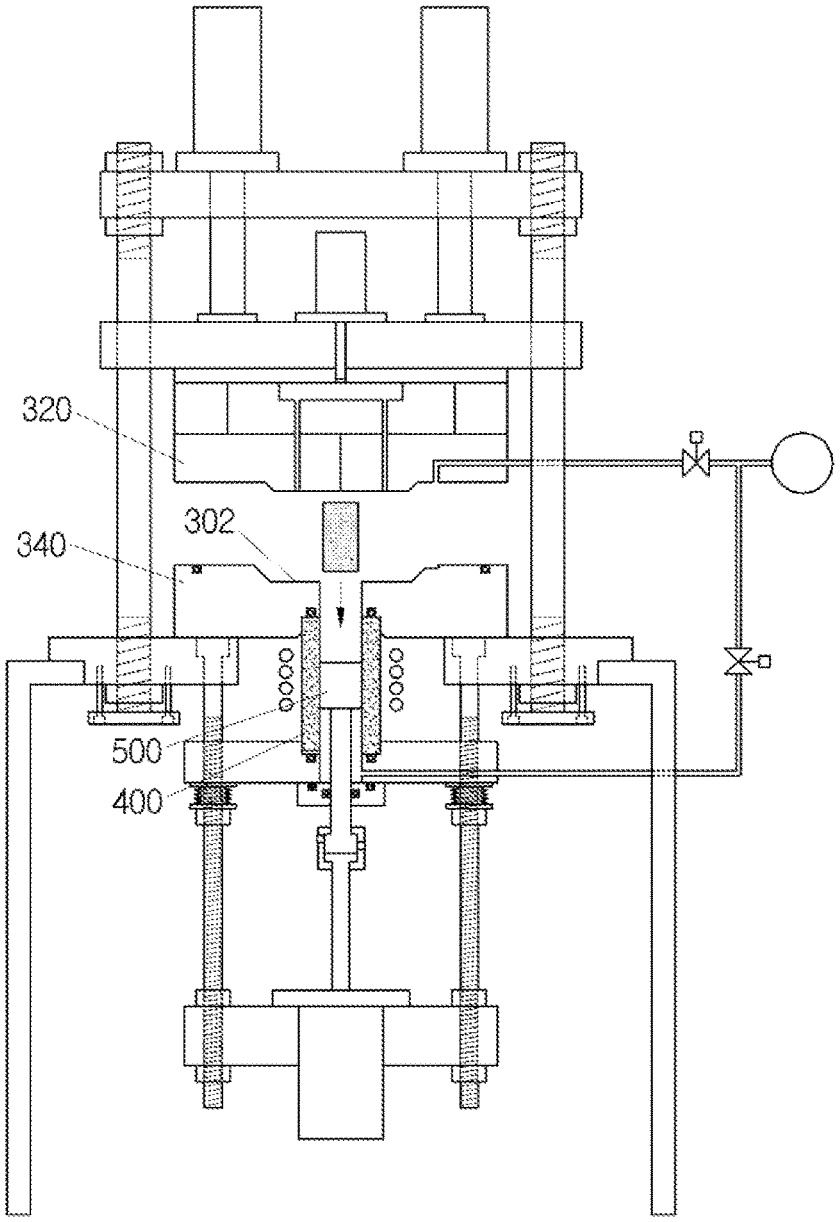

[FIG. 5]
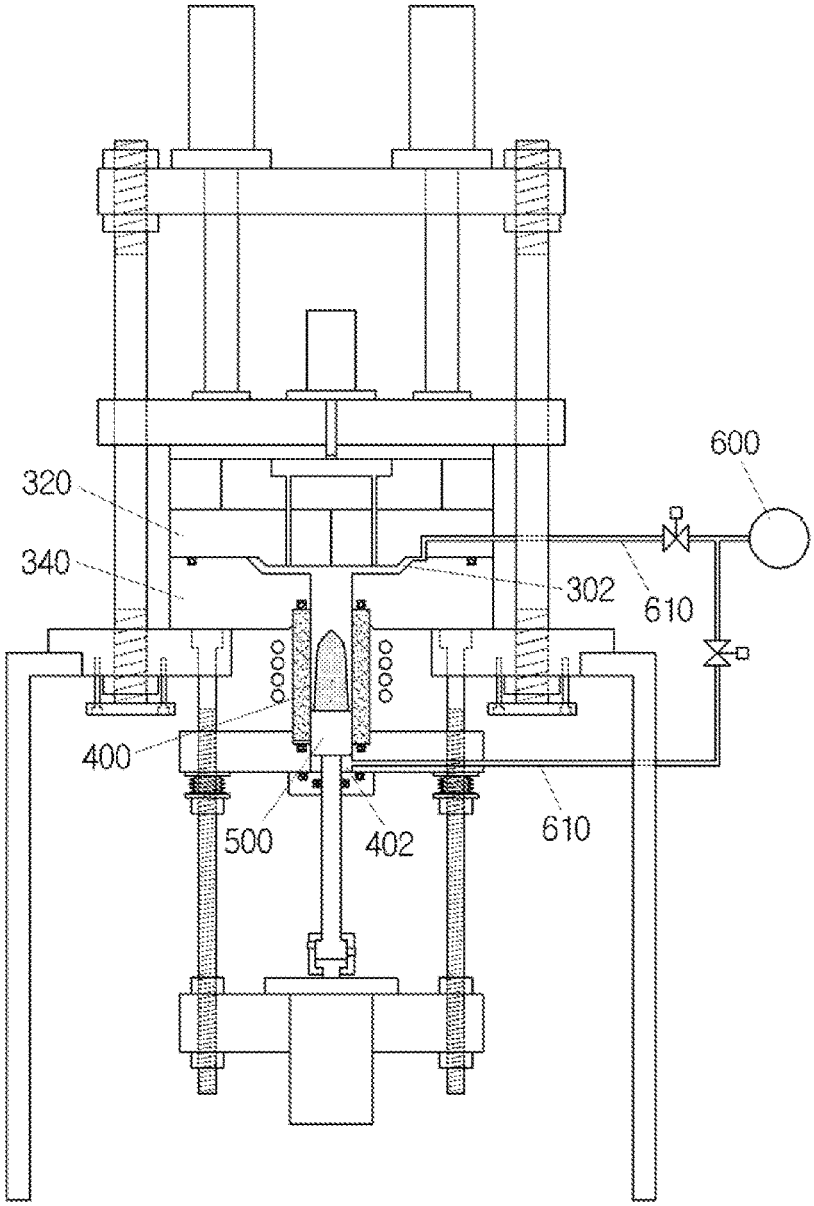

[FIG. 6]
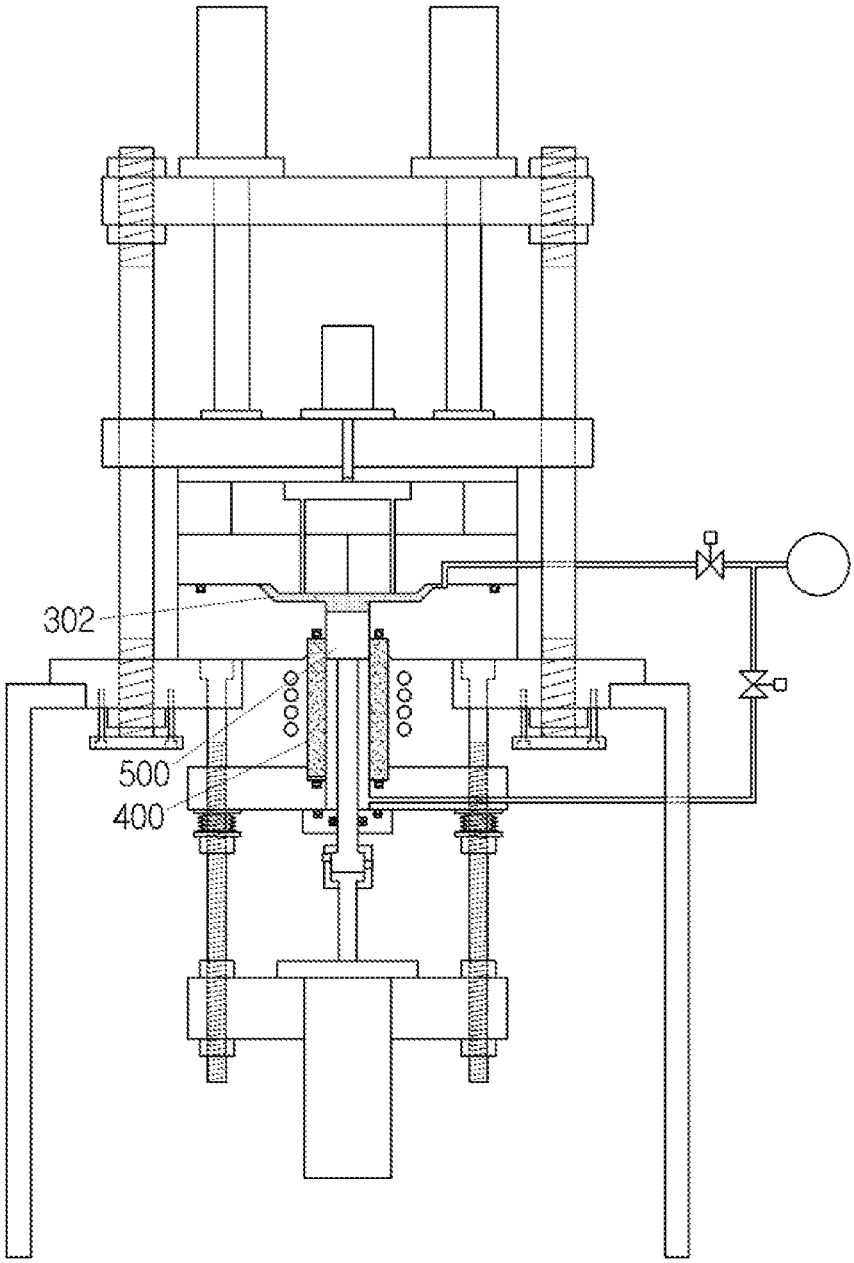

[FIG. 7]
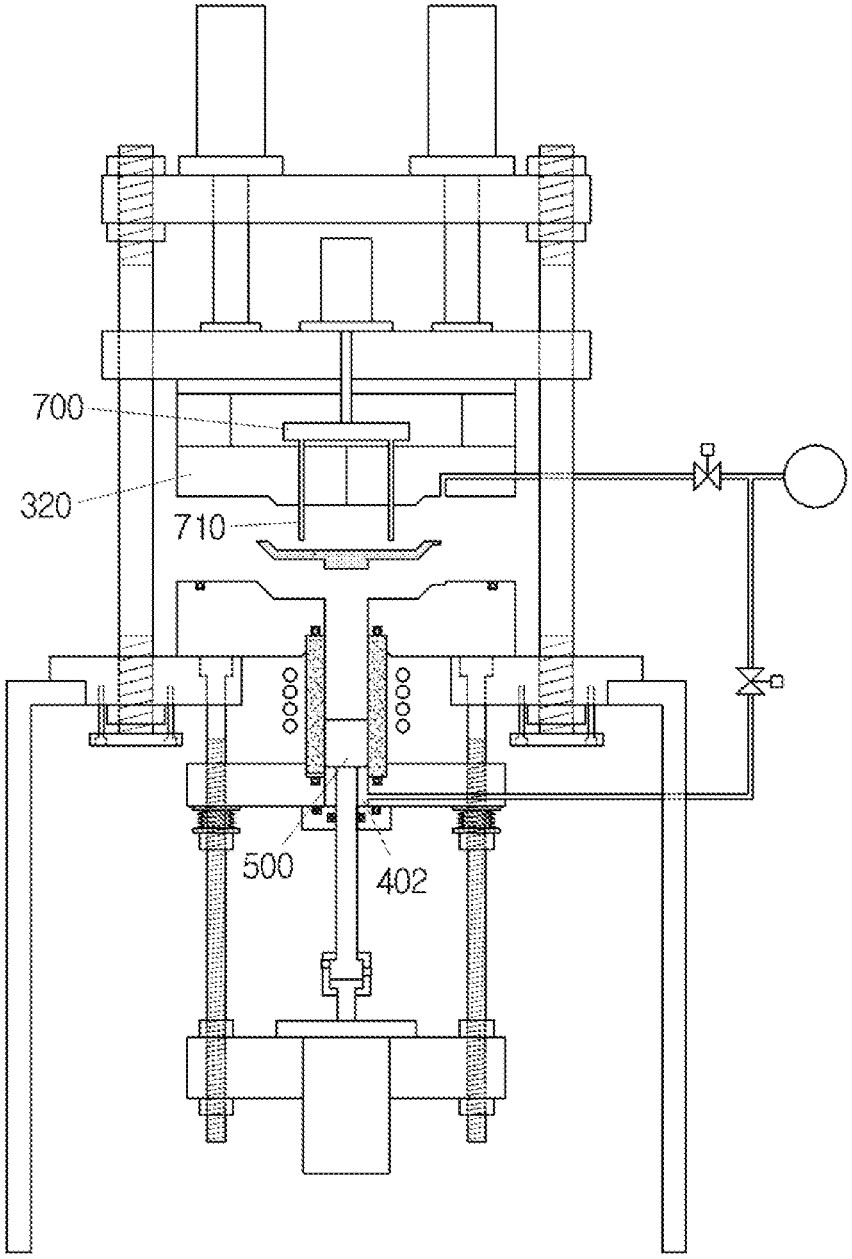

[FIG. 8]
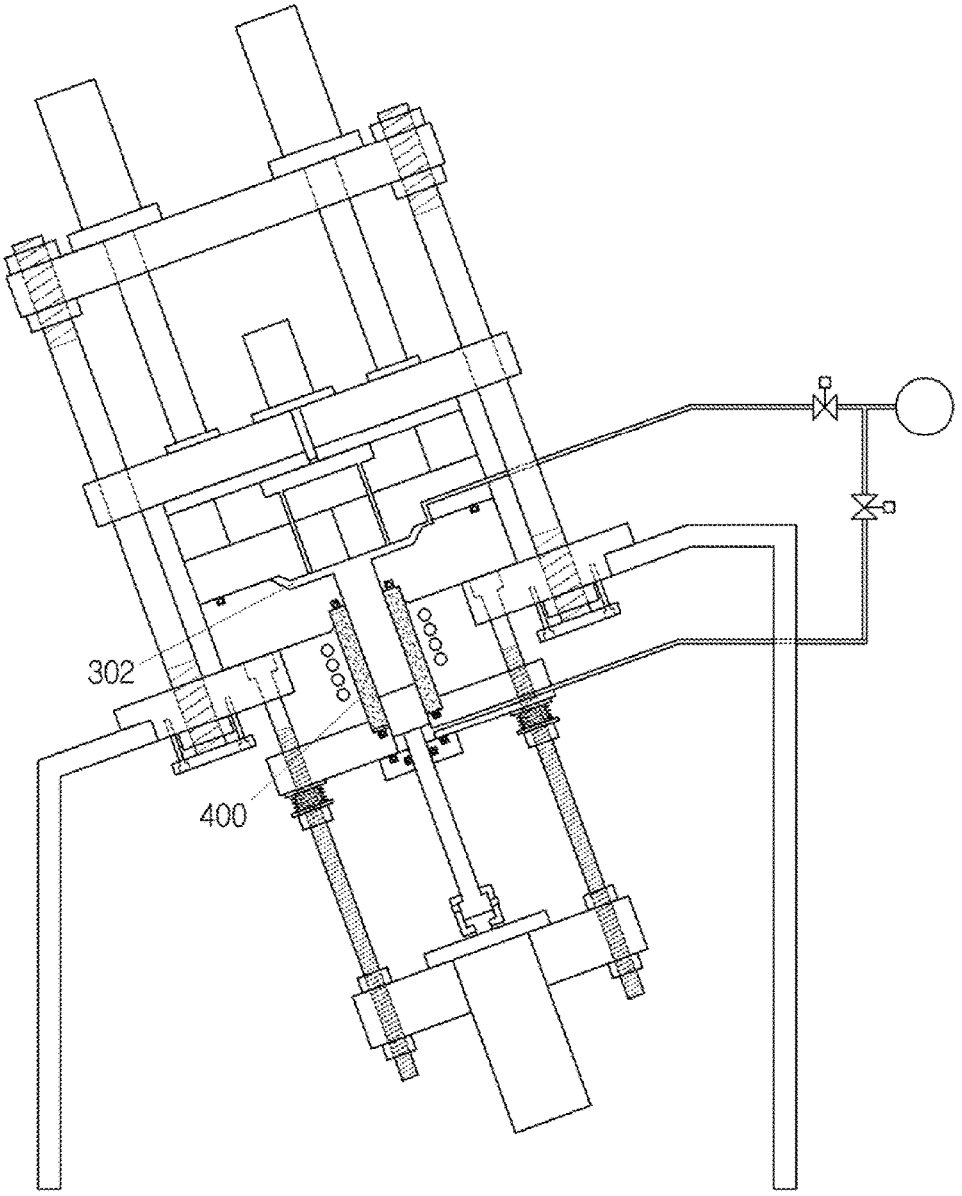

[FIG. 9]
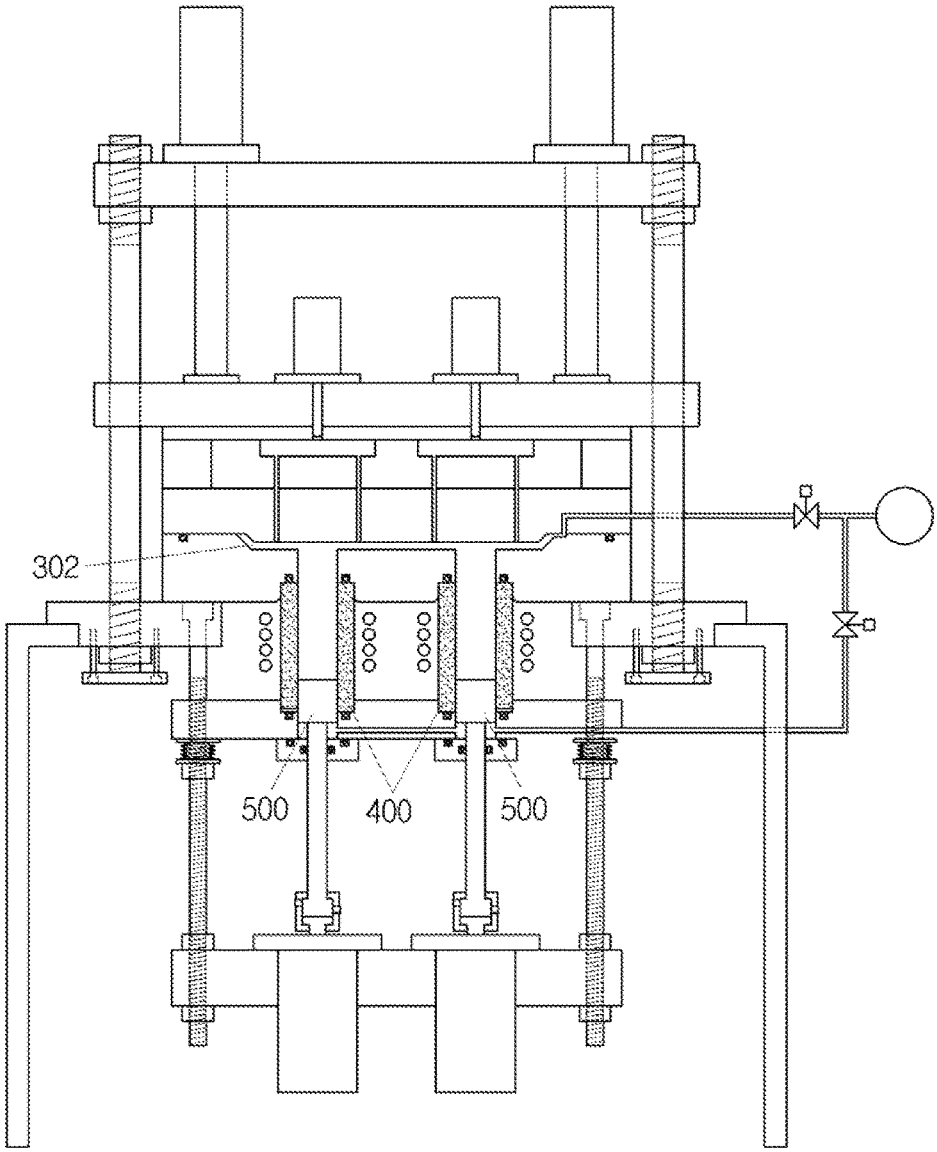

[FIG. 10]
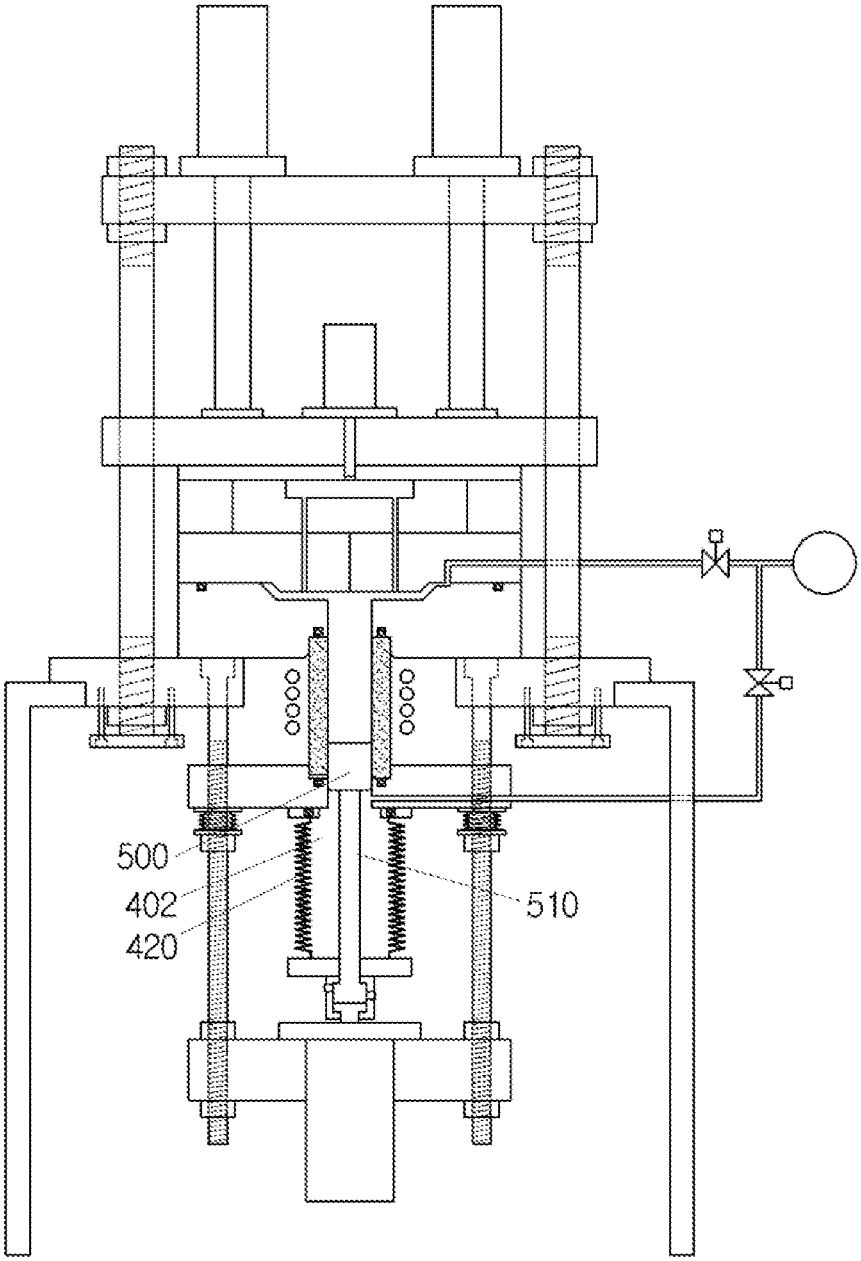

[FIG. 11]
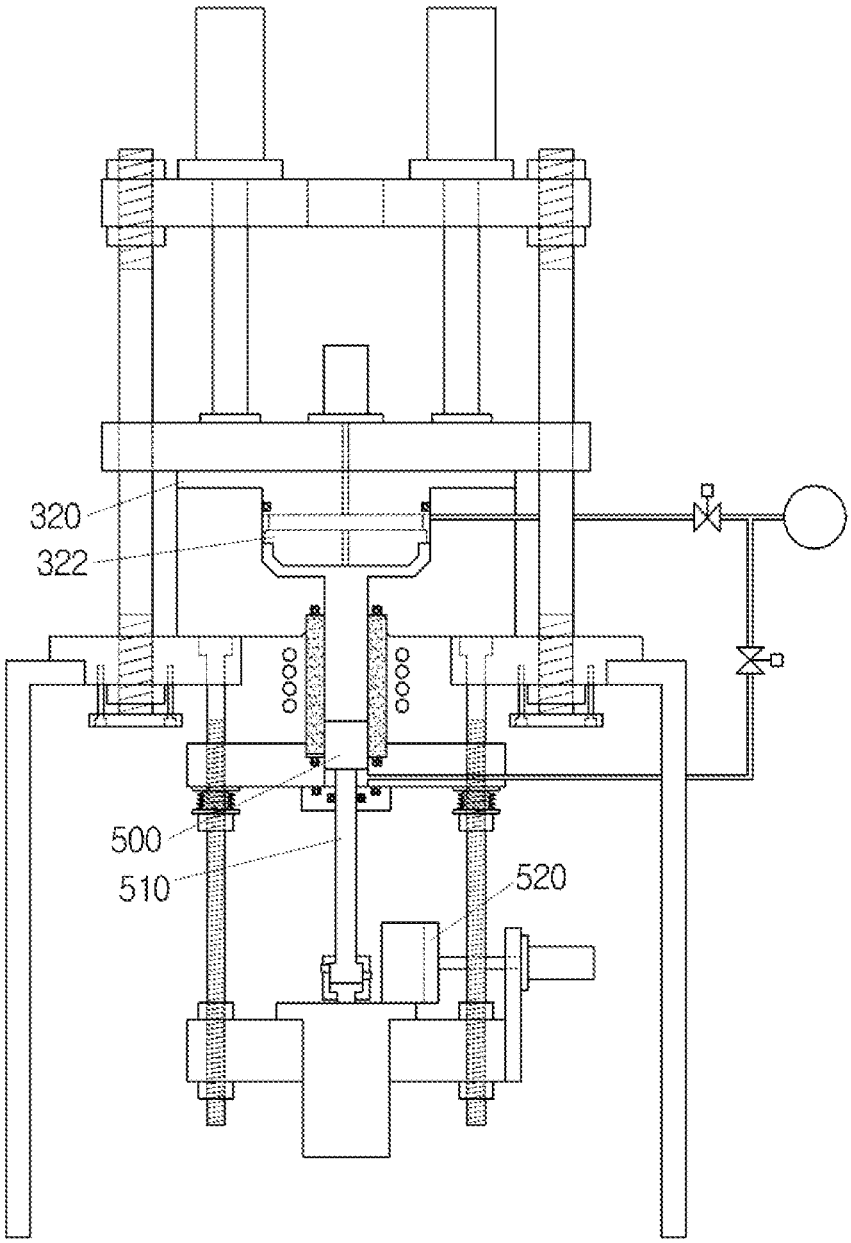

DEVICE AND METHOD FOR MELTING AND FORMING METAL IN VACUUM ENVIRONMENT

CROSS-REFERENCES

This application is a 371 of PCT/KR2015/005675 filed Jun. 5, 2015, which claims the benefit of foreign priority of Korean Patent Application No. 10-2014-0079018 filed Jun. 26, 2014, the subject matter of which is hereby incorporated by reference in its entirety.

TECHNICAL FIELD

The present invention generally relates to an apparatus and method for melting and forming metal in a vacuum environment.

BACKGROUND

There are various types of metal forming or forging apparatuses such as a horizontal die casting machine, a vertical die casting machine, a squeeze casting machine, a low-pressure casting machine, a gravity die casting machine, and the like. These apparatuses melt metal in a melting furnace in which the metal is openly exposed to air.

Molten metal rapidly oxidizes upon contact with the air, and this also allows introduction of impurities into the molten metal, thereby forming dross. Although the dross reduces the contact of the molten metal with the air by an insignificant amount, the dross impedes continuous stirring during melting of the metal, thereby reducing the high-quality of the molten metal.

SUMMARY

Accordingly, the present invention seeks to improve the metal forming process for producing higher quality metal products.

In the present invention, metal that is melted in a high-level vacuum is flowed into a mold cavity. The high-level vacuum is created in the apparatus by drawing air from the apparatus, which is sealed from atmospheric air.

The metal forming apparatus according to the present invention can melt and form metal in a high-level vacuum environment formed therein. It is therefore possible to prevent the properties of molten metal from changing through contact with the air. Debris produced during the process of forming metal is separately collected in a space at the rear of a pressing plunger. This separation of debris can prevent it from mixing into the metal, thereby improving the high-quality of the metal product.

BRIEF DESCRIPTION OF DRAWINGS

FIG. 1 is an exemplary view conceptually illustrating the schematic configuration of an apparatus for melting and forming metal in a vacuum environment according to the present invention;

FIG. 2 is an exemplary view illustrating the operation of loading metal by lowering a melting sleeve according to another embodiment of the present invention;

FIG. 3 is an exemplary view illustrating a structure of cooling a pressing plunger applied to the present invention;

FIGS. 4 to 7 are exemplary views illustrating the process of melting and forming metal in a vacuum environment using the apparatus according to the present invention; and FIGS. 8 to 11 are exemplary views conceptually illustrating the schematic configurations of apparatuses for melting and forming metal in a vacuum environment according to other embodiments of the present invention.

DETAILED DESCRIPTION OF THE PREFERRED EMBODIMENTS

The present invention proposes an apparatus and method for melting and forming metal in a vacuum environment in order to create a high-level vacuum environment within a metal-forming mold apparatus and melt and form metal in the high-level vacuum environment. The apparatus includes: a mold having a mold cavity for forming metal; a hollow melting sleeve disposed below and communicating with the mold cavity, the melting sleeve melting the metal loaded thereinto; a pressing plunger, wherein the pressing plunger moves forwards within the melting sleeve to push and fill the molten metal into the mold cavity. The interior of the melting sleeve and the interior of the mold cavity are maintained in a sealed state. A space communicating with the melting sleeve is at the rear of the pressing plunger such that atmospheric air is prevented from entering the space. The apparatus further includes an exhaust unit that creates a vacuum within the space, the mold cavity, and the melting sleeve.

The preferred embodiment will now be described in greater detail with reference to FIGS. 1 to 11.

FIG. 1 is an exemplary view conceptually illustrating the schematic configuration of an apparatus for melting and forming metal in a vacuum environment according to the preferred embodiment. FIG. 2 is an exemplary view illustrating the operation of loading metal by lowering a melting sleeve. FIG. 3 is an exemplary view illustrating a structure of cooling a pressing plunger applied to the preferred embodiment.

As illustrated in the drawings, the apparatus for melting and forming metal in a vacuum environment according to the preferred embodiment includes a mold 300 having a mold cavity 302, which is a space in which metal is formed, a melting sleeve 400 that melts the metal, and a pressing plunger 500 pressing and filling the metal melted by the melting sleeve 400 into the mold 300.

The mold 300 is divided into a movable mold 320 and a fixed mold 340. When the movable mold 320 moves upwards, the mold cavity 302 is opened. Packing is disposed at an area in which the movable mold 320 adjoins the fixed mold 340, and serves to close the mold cavity 302 when the movable mold 320 adjoins the fixed mold 340.

The fixed mold 340 is fixedly disposed on top of a plate-shaped fixed platen 200 having a preset area. The fixed platen 200 is at a preset height from the bottom, supported on a body frame 100.

The movable mold 320 moves upwards and downwards along a tie bar 820, the lower end of which is fixedly erected on the fixed platen 200. A movable platen 800 is disposed on the tie bar 820, and the movable mold 320 is fixed to the movable platen 800. In response to the movable platen 800 moving upwards and downwards along the tie bar 820, the movable mold 320 moves upwards and downwards.

The upward and downward movement of the movable platen 800 is enabled by a mold opening/closing cylinder 900. The mold opening/closing cylinder 900 is fixed to a cylinder support 920 fixed to the upper end of the tie bar 820, and operates the movable platen 800 through the forward and backward movement of a cylinder rod 910.

The movable mold 320 is provided with an ejector plate 700 that ejects a formed product out of the mold cavity 302. The ejector plate 700 has ejector pins 710 that extend to the mold cavity 302 through the movable mold 320. The ejector pins 710 can detach the product from the movable mold 320, (the product being formed in the mold cavity 302), while moving forward.

The melting sleeve 400 is in the shape of a pipe having a hollow interior. In addition, the melting sleeve 400 may be formed of an insulator, such as a ceramic. The melting sleeve 400 has an induction heating coil 410 wound on the outer circumference thereof. The induction heating coil 410 can directly heat metal within the melting sleeve 400 by induction heating. The melting sleeve 400 is configured such that the melting sleeve 400 extends through the fixed platen 200, with the upper end thereof adjoining the lower portion of the fixed mold 340. Thus, the interior of the melting sleeve 400 communicates with the mold cavity 302. Here, the packing closes the area in which the melting sleeve 400 adjoins the underlying mold 300.

The melting sleeve 400 may be configured such that the melting sleeve 400 moves upwards and downwards as illustrated in FIG. 2. A sleeve support 460 is provided to support the lower end of the melting sleeve 400, and is configured such that the upward and downward movement of the upper end of the sleeve support 460 following a support rod 470 fixed to the fixed platen 200 causes the melting sleeve 400 to move upwards and downwards. According to this configuration, it is possible to load metal to be melted into the melting sleeve 400 by lowering the melting sleeve 400.

The lower end of the melting sleeve 400 is closed. The sleeve support 460 has a recess into which the lower end of the melting sleeve 400 can be fitted. The lower end of the melting sleeve 400 is stuck into the recess of the sleeve support 460. A hole communicating with the interior of the melting sleeve 400 extends through the sleeve support 460. As the lower end of this hole is closed, the lower end of the melting sleeve 400 is closed. Accordingly, in the state in which the upper end of the melting sleeve 400 adjoining the fixed mold 340 is closed, the melting sleeve 400 can be closed such that air does not enter the interior of the melting sleeve 400.

It is preferable that the size of the hole be identical to the inner diameter of the melting sleeve 400, but this is not intended to be limiting.

The hole can be closed using a closing flange 480. The closing flange 480 is fixed to close the lower end of the hole formed in the sleeve support 460. Here, a plunger rod 510, which will be described later, extends through the closing flange 480. The packing is disposed on the portion in which the sleeve support 460 adjoins the closing flange 480 and the portion in which the plunger rod 510 extends through the closing flange 480, thereby maximizing closing performance.

The pressing plunger 500 is in a piston shape that moves forwards and backwards within the melting sleeve 400. The pressing plunger 500 is disposed on the upper end of the plunger rod 510 such that the pressing plunger 500 moves forwards and backwards. The plunger rod 510 can be connected to the cylinder rod by means of a coupling, the cylinder rod being moved forwards and backwards by a cylinder.

When metal loaded into the melting sleeve 400 melts, the pressing plunger 500 moves forwards to push the molten metal into the mold cavity 302, thereby filling the mold cavity 302 with the molten metal. At rear of the pressing plunger 500, there is a space 402 having a preset volume. The space 402 is formed such that the pressing plunger 500 does not touch the closing flange 480 even if the pressing plunger 500 moves backwards to the rearmost position. Metal debris dropping through the gap between the pressing plunger 500 and the inner wall surface of the melting sleeve 400 accumulates in the space 402 during the process of forming the metal. Consequently, the metal debris does not mix into the metal that is being formed.

A cooling means is provided to cool the pressing plunger 500. For this, a cooling configuration as illustrated in FIG. 3 can be employed. According to the cooling configuration, both the interior of the plunger rod 510 and the interior of the pressing plunger 500 are hollow, and a pipe extends through the hollow interiors, such that coolant can be flowed through the pipe. However, this is not intended to be limiting, and any other means can be employed as required.

According to the preferred embodiment, an exhaust unit 600 for evacuating the interior of the above-described apparatus for forming metal is provided. The exhaust unit 600 draws air from the interior of the mold cavity 302, the interior of the melting sleeve 400, and the space 402 formed in the rear of the pressing plunger 500 through a plurality of exhaust pipes 610. Since the mold cavity 302 and the melting sleeve 400 communicates with each other, the air is drawn from the interior of the mold cavity 302 and the interior of the melting sleeve 400 through one of the exhaust pipes 610 communicating with the mold cavity 302. The air is drawn from the space 402 through the other one of the exhaust pipes 610 communicating with the space 402. Since air is simultaneously drawn in this manner, according to the preferred embodiment, it is possible to rapidly evacuate the interior of the apparatus to create a vacuum environment for melting and forming metal.

Since it is possible to completely close the interior of the apparatus, metal is melted and formed in a high level of vacuum that is created in the interior of the apparatus. In addition, it is possible that the space 402 in the rear of the pressing plunger 500 can collect metal debris. It is therefore possible to repeat the operation of forming metal while preventing the metal debris from mixing into the metal.

Reference will now be made to a process of melting and forming metal in a vacuum environment using the above-described apparatus for melting and forming metal in a vacuum environment according to the preferred embodiment. FIGS. 4 to 7 are exemplary views illustrating the process of melting and forming metal in a vacuum environment using the apparatus of the preferred embodiment.

First, metal to be melted is loaded into the melting sleeve 400. The mold cavity 302 is opened by moving upwards the movable mold 320 illustrated in FIG. 4, the interior of the mold cavity 302 is cleaned by blowing high-pressure air thereinto, and a releasing agent and a lubricant are subsequently injected thereinto. Afterwards, the pressing plunger 500 is moved upwards to a position slightly lower than the entrance of the melting sleeve 400, and the metal to be melted is placed on the pressing plunger 500. Since the pressing plunger 500 is moved upwards, it is possible to prevent the pressing plunger 500 from being damaged by softly placing the metal on the top surface of the pressing plunger 500.

Thereafter, as illustrated in FIG. 5, the pressing plunger 500 is moved downwards, and the loaded metal starts to be heated. At the same time, the movable mold 320 is moved downwards and is assembled with the fixed mold 340, thereby closing the mold cavity 302. The pressing plunger 500 is moved downwards to a position in which electromagnetic induction force is easily transferred to the metal. At the same time, air is drawn simultaneously from the mold cavity 302, the melting sleeve 400, and the space 402 at the rear of the pressing plunger 500 through the exhaust pipes 610 by operating the exhaust unit 600.

Since the air is drawn in this manner, there is no or very insignificant pressure difference between the interiors of the mold cavity 302 and the melting sleeve 400 and the space 402 at the rear of the pressing plunger 500. This consequently prevents metal debris contaminated with impurities that would otherwise accumulate in the space 402 at the rear of the pressing plunger 500 from being sucked in the direction of the melting sleeve 400 through the gap between the inner wall surface of the melting sleeve 400 and the pressing plunger 500. Accordingly, the impurity-contaminated metal debris is prevented from mixing into the metal that will be melted within the melting sleeve 400, thereby producing high-quality molten metal.

When the loaded metal is sufficiently heated to melt, as illustrated in FIG. 6, the pressing plunger 500 is moved upwards, thereby filling the molten metal into the mold cavity 302. Afterwards, the molten metal is left to cool in this state for a preset time, such that a metal product is formed in the shape of the mold cavity 302.

When the cooling is completed, as illustrated in FIG. 7, the movable mold 320 is moved upwards. At this time, the formed product is moved upwards, attached to the movable mold 320. The formed product is removed from the movable mold 320 through the ejector pins 710 by moving the pressing plunger 500 backwards and subsequently moving the ejector plate 700 downwards. Afterwards, the product is finished through a post treatment process, such as polishing or paining.

Metal is melted and formed by repeating the above-described process, during which metal debris dropping through the gap between the pressing plunger 500 and the inner wall surface of the melting sleeve 400 accumulates in the space 402. Accordingly, the space 402 may be periodically cleaned to remove the accumulated metal debris.

Reference will now be made to a variety of embodiments according to the principle of the present invention. FIGS. 8 to 11 are exemplary views conceptually illustrating the schematic configurations of apparatuses according to other embodiments of the preferred embodiment.

In the state in which the mold 300 is assembled as illustrated in FIG. 2, the melting sleeve 400 is moved downwards to be separated from the mold 300, and metal to be melted is loaded into the melting sleeve 400. Afterwards, the melting sleeve 400 is moved upwards to be close to the mold 300. A high-level vacuum environment is created in the mold cavity 302, the melting sleeve 400, and the space 402 at the rear of the pressing plunger 500 by drawing air therefrom, and the metal is simultaneously heated. Afterwards, the pressing plunger 500 is moved upwards, thereby filling the molten metal into the mold cavity 302.

As illustrated in FIG. 8, the mold cavity 302 and the melting sleeve 400 are disposed at upper and lower positions on a line inclined with respect to a horizon. That is, the line on which the mold cavity 302 and the melting sleeve 400 are disposed is inclined with respect to the horizon. This configuration is employed in order to fill molten metal along the inclined line into the mold cavity 302.

As illustrated in FIG. 9, a plurality of melting sleeves 400 is provided. Each of the plurality of melting sleeves 400 is provided with a pressing plunger 500. This configuration makes it possible to melt metal using the plurality of melting sleeves 400 and subsequently fill the molten metal into the mold cavity 302, thereby increasing the rate at which the metal is formed. In addition, when the size of a product to be formed is large, it is possible to simultaneously fill a greater amount of metal. Accordingly, a variety of products can be conveniently formed.

As illustrated in FIG. 10, the space 402 at the rear of the pressing plunger 500 may be implemented as a bellows 420. The bellows 420 is in the shape of a corrugated pipe, with the upper end thereof being firmly and closely fastened to the sleeve support 460, and the lower end thereof being closed. The plunger rod 510 extends through the lower end of the bellows 420. Since the bellows 420 forms the space 402, the space 402 may be sufficiently large to receive a significant amount of metal debris. Since the bellows 420 expands and contracts in response to the plunger rod 510 moving upwards and downwards, the friction between the bellows 420 and the outer circumference of the plunger rod 510 can be minimized.

As illustrated in FIG. 11, the preferred embodiment is applicable to an apparatus for melting and forging metal in a vacuum environment. In this case, the movable mold 320 is provided with a punching part 322. When molten metal is moved upwards on the pressing plunger 500, the movable mold 320 moves downwards such that the punching part 322 forms the molten metal by applying pressure thereto. At this time, the force pressing against pressing plunger 500 pushes the pressing plunger 500 backwards. The pressing plunger 500 is firmly supported by a support block 520.

For example, the plunger rod 510 can be connected to the cylinder rod by means of a coupling, the cylinder rod being moved forwards and backwards by a cylinder, such that the plunger rod 510 can move forwards and backwards. The support block 520 has a U-shaped recess that supports the lower portion of the coupling while covering the cylinder rod.

When metal is forged as above, the punching part 322 and the pressing plunger 500 may simultaneously press the molten metal.

Therefore, the present invention has been described in terms of a preferred embodiment, it is apparent that other forms could be adopted by one skilled in the art. Accordingly, it should be understood that the present invention is not limited to the preferred embodiment illustrated in the Figures. It should also be understood that the phraseology and terminology employed above are for the purpose of disclosing the illustrated embodiment, and do not necessarily serve as limitations to the scope of the invention.

The invention claimed is:

1. An apparatus for forming metal in a vacuum environment, comprising:

a mold having a mold cavity;

a hollow melting sleeve disposed below and communicating with the mold cavity wherein the melting sleeve is for melting metal loaded thereinto;

a pressing plunger that moves forward within the melting sleeve to push and fill molten metal into the mold cavity;

a sleeve support configured to support the lower end of the melting sleeve, the sleeve support having an inner channel commmunicating with the interior of the melting sleeve, the inner channel extending through the sleeve support;

a space enclosed by a closing flange, the melting sleeve, the inner channel, and the pressing plunger, at the rear of the pressing plunger, the space communicating with the melting sleeve such that metal debris dropping through a gap between the pressing plunger and the melting sleeve collects in the space during the metal forming process;

wherein an interior of the melting sleeve, an interior of the mold cavity, and the space are sealed from atmospheric air; and an exhaust unit having first and second exhaust pipes, the first pipe communicating with the mold cavity, the second pipe communicating with the space through the sleeve support, wherein the exhaust unit draws air from the mold cavity, the melting sleeve, and the space.

2. The apparatus according to claim 1, wherein the mold cavity and the melting sleeve are disposed at upper and lower positions on a line inclined with respect to a horizontal plane.

3. The apparatus according to claim 1, further comprising a plurality of melting sleeves, each of which melts the metal, which is then flowed into the mold cavity.

4. The apparatus according to claim 1, wherein the space at the rear of the pressing plunger comprises a bellows.

5. The apparatus according to claim 1, wherein the melting sleeve is provided separable from the mold, wherein the metal to be melted is loaded into the melting sleeve with the melting sleeve being separated from the mold.

6. The apparatus according to claim 1, further comprising a support block supporting the pressing plunger; and wherein the movable mold has a punching part that forges the molten metal by applying pressure thereto.

7. The apparatus according to claim 6, wherein, when the punching part applies pressure to the molten metal, the pressing plunger moves upwards and applies pressure to the molten metal together with the punching part.

8. A method of melting and forming metal, comprising:

having an apparatus of claim 1;

loading the metal to be melted into the melting sleeve by opening the melting sleeve;

assembling the mold after loading the metal to be melted into the melting sleeve; and creating a vacuum within the mold cavity, the melting sleeve, and the space by simultaneously drawing air therefrom.

9. The method according to claim 8, wherein the step of loading the metal into the melting sleeve comprises moving the pressing plunger forward to a position close to an entrance of the melting sleeve, placing the metal to be melted on top of the pressing plunger, and moving the pressing plunger backwards.

* * * * *